US006865761B2

(12) United States Patent
Henke et al.

(10) Patent No.: US 6,865,761 B2
(45) Date of Patent: Mar. 15, 2005

(54) APPARATUS AND METHOD FOR OPENING A CONTAINER AND MIXING AND CLEANING A CONTAINER

(75) Inventors: David Henke, Maple Grove, MN (US); Steven Thompson, Bloomington, MN (US)

(73) Assignee: Warner Manufacturing Company, Minneapolis, MN (US)

( * ) Notice: Subject to any disclaimer, the term of this patent is extended or adjusted under 35 U.S.C. 154(b) by 29 days.

(21) Appl. No.: 10/305,613

(22) Filed: Nov. 26, 2002

(65) Prior Publication Data

US 2003/0097717 A1 May 29, 2003

Related U.S. Application Data

(60) Provisional application No. 60/334,329, filed on Nov. 29, 2001.

(51) Int. Cl.[7] ..... B67B 7/00

(52) U.S. Cl. ..... 7/151; 7/105

(58) Field of Search ..... 7/151, 152, 156, 7/132, 113, 142, 169; D8/34; 81/309, 3.55

(56) References Cited

U.S. PATENT DOCUMENTS

| | | | | | |
|---|---|---|---|---|---|
| 4,409,863 | A | * | 10/1983 | Anderson | 81/3.09 |
| 4,967,436 | A | * | 11/1990 | Russell | 7/156 |
| 5,069,090 | A | * | 12/1991 | Clark | 81/3.09 |
| 6,640,369 | B1 | * | 11/2003 | Malvasio | 7/105 |
| 2003/0208850 | A1 | * | 11/2003 | Tague et al. | 7/151 |

* cited by examiner

*Primary Examiner*—Lee D. Wilson
(74) *Attorney, Agent, or Firm*—Merchant & Gould P.C.

(57) ABSTRACT

An apparatus for opening a container, mixing the contents contained in the container, and cleaning the container by removing its contents using a single tool. In removing the contents, the tool has a sharpened edge with a radial curvature for scraping the sides of the container.

17 Claims, 5 Drawing Sheets

APPARATUS AND METHOD FOR OPENING A CONTAINER AND MIXING AND CLEANING A CONTAINER

This application claims the benefit of U.S. Provisional Application Ser. No. 60/334,329, filed Nov. 29, 2001, titled APPARATUS FOR OPENING A CONTAINER AND FOR MIXING AND CLEANING A CONTAINER, which is incorporated herewith by reference in its entirety.

FIELD OF THE INVENTION

This invention is related to an apparatus for opening a container, mixing contents in a container, and for cleaning a container. More particularly, this invention is related to an apparatus that can open a container, mix and clean out contents in a container in a single tool.

BACKGROUND OF THE INVENTION

Many tools are used in finishing dry wall architecture. Typically, a container or bucket, containing dry wall plaster materials to be applied to surfaces such as walls, needs to be opened, mixed and cleaned out. In the past, multiple tools have been used to handle these tasks. However, producing separate tools for each task may not be cost effective, and also presents inconveniences due to the multiple tools needed for handling and manipulation. Further, cleaning out buckets containing dry wall materials using scraping tools having a conventional flat shape causes overly repetitive scraping of the sides. In addition, such scraping tools can require inconvenient manipulation of the tool and cumbersome situating of the bucket in accessible positions, such as tilting, turning, etc., so that the scraping tool can reach the sides of the bucket.

Therefore, there is a need for an improved device that can more efficiently and easily scrape a container of its contents such as plaster material for dry wall finishing, and that also can open the container and mix the contents of the container in one tool.

SUMMARY OF THE INVENTION

In accordance with the present invention, the above and other problems were solved by providing an apparatus that opens a container, mixes contents contained in the container, and cleans out the container.

In one embodiment of the present invention, an apparatus that opens a container, mixes contents contained in the container, and cleans out the container includes an elongated member having a first end and a second end. The first end contains an opener head. The second end includes a tool support member having first and second ends and an extended width including at least one cut out region defined through a first side and through a second side of the body. The second end also defines a sharpened edge disposed along the width at the second end of the body.

In one embodiment of the present invention, an apparatus that opens a container, mixes contents contained in the container, and cleans out the container includes an elongated member having a first end and a second end. The first end contains an opener head. The second end includes a tool support member having first and second ends and being substantially flat defining a first side and a second side. The body may include an extended width having at least one cut out region defined through the first and the second sides of the body. The second end also defines a sharpened edge disposed along the width at the second end of the body.

In one embodiment of the present invention, an apparatus that opens a container, mixes contents contained in the container, and cleans out the container includes an elongated member having a first end and a second end. The first end contains an opener head. The second end includes a tool support member having first and second ends and an extended width including at least one cut out region defined through a first side and through a second side of the body. The second end also includes a sharpened edge disposed along the width at the second end of the body. The sharpened edge defines a radial curvature that substantially corresponds to a sidewall of a container such that the sharpened edge is contactable with the sidewall of the container.

In one embodiment of the present invention, the sharpened edge includes two oppositely disposed sides. At least one of the sides defines a radial curvature that substantially corresponds to a sidewall of a container such that the sharpened edge substantially contours the sidewall of the container. The other side may be substantially flat, such that a cross-section size of the sharpened edge increases toward a middle portion of the sharpened edge.

In one embodiment of the present invention, an apparatus that opens a container, mixes contents contained in the container, and cleans out the container, the apparatus being formed of one tool.

In one embodiment of the present invention, an apparatus that opens a container, mixes contents contained in the container, and cleans out the container includes being formed of a plastic material.

In one embodiment of the present invention, an apparatus that opens a container, mixes contents contained in the container, and cleans out the container includes being integrally molded of a plastic material as one tool.

In one embodiment of the present invention, an apparatus that opens a container, mixes contents contained in the container, and cleans out the container is disposable after use.

In one embodiment of the present invention, an apparatus that opens a container, mixes contents contained in the container, and cleans out the container includes being formed of a chemical resistant plastic material.

In one embodiment of the present invention, an opener head may be C-shaped opener head having at least one hook member associated thereon.

In one embodiment of the present invention, a method for removing contents from a container includes providing an apparatus including an elongated member having a first end and a second end. The first end contains an opener head. The second end includes a tool support member having first and second ends and an extended width including at least one cut out region defined through a first side and through a second side of the body. The second end also includes a sharpened edge disposed along the width at the second end of the body. The sharpened edge defines a radial curvature that substantially corresponds to a sidewall of a container such that the sharpened edge may contour and may be substantially contactable with the sidewall of the container. The container can be opened with the opener head. The contents of the container can be mixed by stirring the contents where the cut outs allow flow through the tool support member during mixing. The container may be emptied and the sharpened edge including its radial curvature allows a downward scraping of the container so as to clean out the container of its contents.

The present invention provides the advantage of an apparatus being able to open a container, mix the contents contained within the container, and scrape the container clean of its contents. The invention provides the above features in one tool that is both convenient to use and cost effective. Further, the radial sharpened edge allows for the apparatus to thoroughly clean the container of its contents by scraping the edge along the sidewall of the container. Preferably, the apparatus can be used on containers holding materials such as but not limited to plasterboard and drywall products, and also paint and driveway sealer products.

These and other various advantages and features of novelty, which characterize the invention, are pointed out in the following detailed description. For better understanding of the invention, its advantages, and the objects obtained by its use, reference should also be made to the drawings which form a further part hereof, and to accompanying descriptive matter, in which there are illustrated and described specific examples of an apparatus in accordance with the invention.

DETAILED DESCRIPTION OF THE PREFERRED EMBODIMENT

In the following description of the illustrated embodiments, reference is made to the accompanying drawings that form a part hereof, and in which is shown by way of illustration of the embodiments in which the invention may be practiced. It is to be understood that other embodiments may be utilized as structural changes may be made without departing from the spirit and scope of the present invention.

Figure 1:
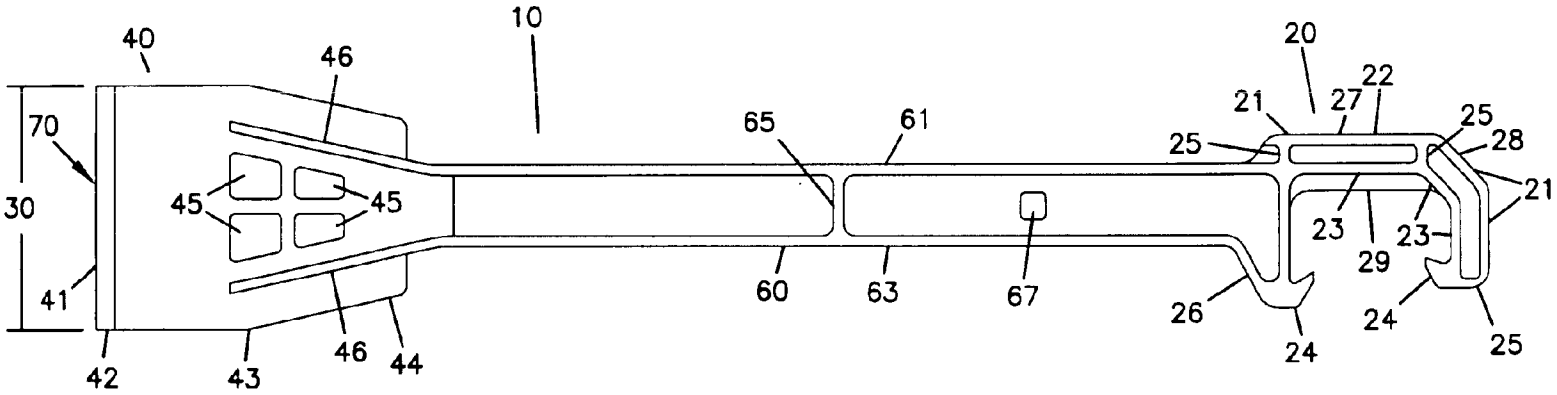
FIG. 1 represents a plan view of one embodiment in accordance with the principles of the present invention.

FIG. 1 illustrates one preferred embodiment of an apparatus 10 that opens a container, mixes contents contained in the container, and cleans out the container. The apparatus 10 includes an elongated member 60 having a first end 20 and a second end 40. The first end 20 includes an opener head 22. The opener head 20 is used for opening a container such as but not limited to a bucket. Preferably, the apparatus 10 is used for opening, mixing, and cleaning out five gallon buckets. Preferably, the five gallon buckets or containers are conventional buckets used for holding materials such as but not limited to plasterboard and drywall products, and also, paint and driveway sealer products. The elongated member 60 may have a length suitable for reaching the bottom of a container such as the five-gallon buckets. Preferably, the elongated member 60 has a length so that the opener head 22 does not enter the container, and does not contact any of the contents in the container. An opening 67 may be disposed along the elongated member 60 for providing a structure so that the apparatus 10 can be stored, such as for hanging on a wall or the like. The opener head 22 may have a longitudinal portion 27 with outwardly extending portions 26, 28 that extend from a side of the first end 20 in the same direction as and parallel to each other. Hook members 24 associated on the portions 26 and 28 provide means for prying open a container such as by engaging a lip of a resealable cover of the container or bucket. The apparatus 10, using the opener head 22, may be worked along the lip of the resealable cover so as to open the container. FIG. 1 shows an exemplary opener head 22 in which the opener head 22 resembles a C-shape opener head. However, it should be appreciated that another suitable opener head may be employed to achieve the same opening function.

The second end 40 includes a tool support member 43 having a first end 44 and a second end 42 and two oppositely disposed sides 47 and 49. Support members 46 extend longitudinally from the elongated member and connect with the tool support member 43 to provide structural support of the second end 40 and tool support member 43. Preferably, the side 47 is formed of a substantially smooth surface preventing obstruction therealong. The tool support member 43 includes a sharpened edge 41, such as a beveled edge or slanted tip at the second end 42. The sharpened edge 41 may be disposed along a width 30 of the tool support member 43. The sharpened edge 41 allows the apparatus 10 to scrape the sides of a container so as to clean the container of its contents.

At least one cut out 45 is disposed on the tool support member 43 between the first end 44 and the second end 42. The cut outs 45 are defined as openings through the tool support member 43, through the first side 47 and the second side 49 (shown in FIGS. 2–3). For mixing purposes such as mixing plasterboard or dry wall materials, the cut outs 45 allow flow of the contents in the container through the tool support member 43. The number of cut out regions 45 illustrated in FIG. 1 is four. However, the number of cut outs illustrated is merely exemplary as more or less cut out regions may be employed as suitable and required when using the apparatus 10 for mixing. Preferably, the tool support member 43 is flat in shape.

Figure 8A:
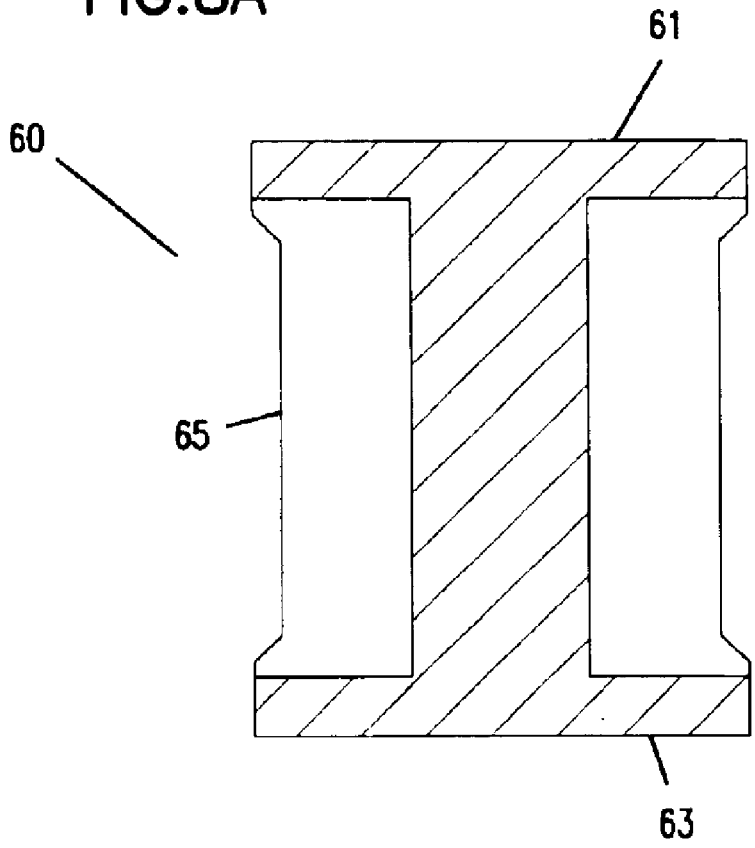
FIG. 8A represents a schematic partial sectional view of one embodiment for an elongated member of the apparatus of FIG. 1.

Further illustrated in FIG. 1, the elongated member 60 of the apparatus 10 preferably is constructed and arranged with oppositely disposed support structures 61, 63 that protrude from sides of the elongated member 60. As best shown in FIG. 8A, the support structures 61, 63 protrude in a direction transverse to the longitudinal direction of the elongated member 60, and extend along the length of the elongated member 60. Preferably, the support structures 61, 63 have the same width, and both may have a width larger along the elongated member 60 proximate the opener head 22 than along the elongated member 60 proximate the tool support member 43.

Further, a bridging portion 65 may be formed between the support structures 61, 63 providing further strength for the apparatus 10. As shown in FIG. 1, only one bridging portion 65 connects the support structures 61, 63 at a middle of the elongated member 60. It will be appreciated that more than one bridging portion may be formed along the elongated member 60 as needed to provide suitable strength. The support structures 61, 63 form and resemble an I shaped beam (FIG. 8A) along the length of the elongated member 60, and provides the apparatus 10 with improved strength, while maintaining a lightweight tool where a minimum amount of material is needed for its construction. Particularly, the support structures 61, 63 and bridging portion 65 can provide handle strength and support for the elongated member 60 when gripping during use, such as in the opening of a container.

Figure 8B:
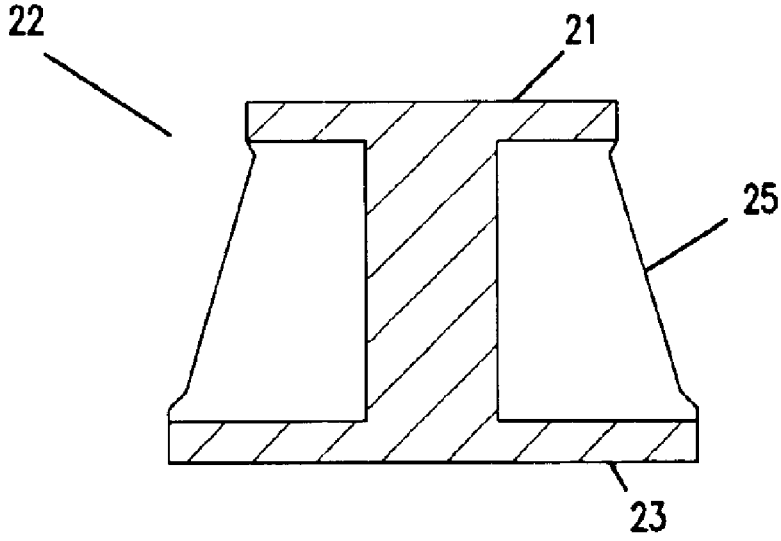
FIG. 8B represents schematic partial sectional view of a portion of one embodiment for an opener head of the apparatus of FIG. 1.

Further, the second end 20 having the opener head 22 also defines oppositely disposed support structures 21, 23 that protrude from sides of the opener head 22. As best shown in FIG. 8B, the support structures 21, 23 protrude at least from the longitudinal portion 27 and the portion 28 in a direction transverse to the direction the portions 27, 28 extend. At least one bridging portion 25 may be formed between the support structures 21, 23 to provide support and strength in the opener head 22. It will appreciated that as many bridging portions may be formed as needed to provide suitable strength and support. A protrusion 29 extends outward in the same direction as and between the portions 26, 28 on the opener head 22 and along the longitudinal portion 27. The protrusion 29 provides further support and strength of the opener head 22. The support structures 21, 23 (FIG. 8B) also form and resemble an I shape configuration similar to support structures 61, 63 on the elongated member, and provide the opener head 22 with improved strength, while maintaining a lightweight tool where a minimum amount of material is needed for its construction. More preferably, the support structure 21 can define a width D that is smaller than the width of the support structure 23 (A in FIGS. 2, 3) further minimizing the amount of material used while still providing suitable strength to the opener head 22. The bridging portions 25 provide increased strength and durability in the opener head 22, such as at points of stress when the apparatus 10 is being used to open a container.

Figure 2:
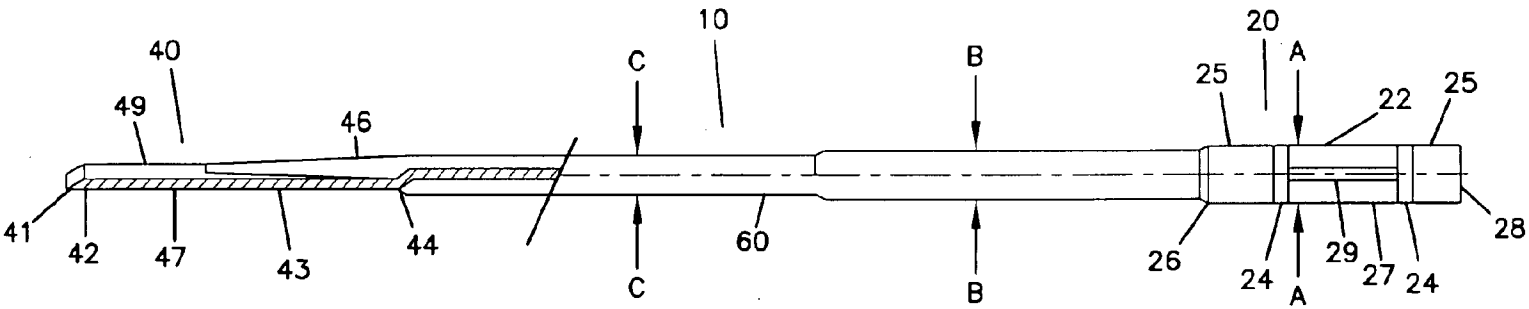
FIG. 2 represents a first side view of the apparatus of FIG. 1 in accordance with the principles of the present invention.
Figure 3:
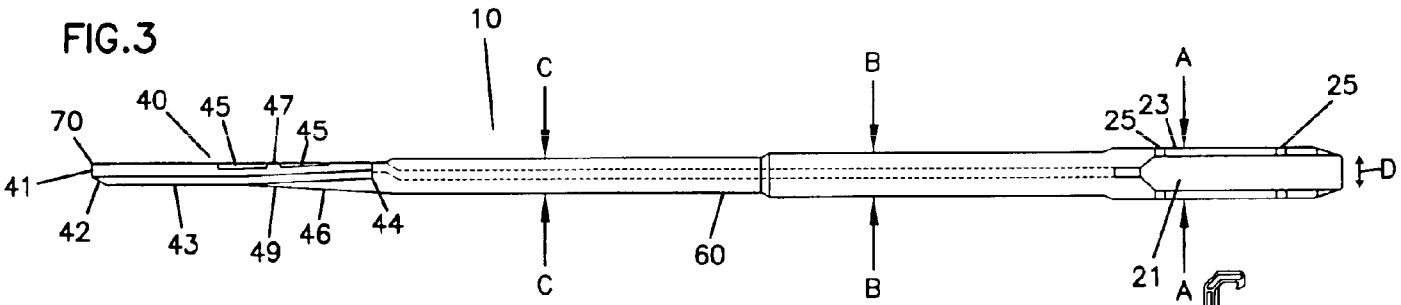
FIG. 3 represents a second side view of the apparatus of FIG. 1 in accordance with the principles of the present invention.

FIGS. 2 and 3 illustrate side views of the apparatus 10. Similar features that have been described in FIG. 1 are not further detailed here. The tool support member 43 is shown in section in FIG. 2. Further illustrated in FIGS. 2 and 3, a first width A is defined along the opener head 22, and preferably corresponds with the width of the support structure 23. A second width B is defined along the elongated member 60 and extends from about a middle of the elongated member toward the first end 20 proximate the opener head 22. A third width C is defined along the elongated member 60 and extends from about the middle of the elongated member toward the second end 40 proximate the tool support member 43. This configuration provides the apparatus 10 having a larger width at the opener head 22 for added strength and durability toward the end 20 at the opener head 22. Preferably, the apparatus 10 is gripped or handled toward the opener head 22 when using the apparatus 10 for opening a container. It will be appreciated that the apparatus 10 along the elongated member 60 and opener head 22 may be other width configurations and arrangements, such as being one uniform width, so long that the strength and durability are not compromised.

Figure 4A:
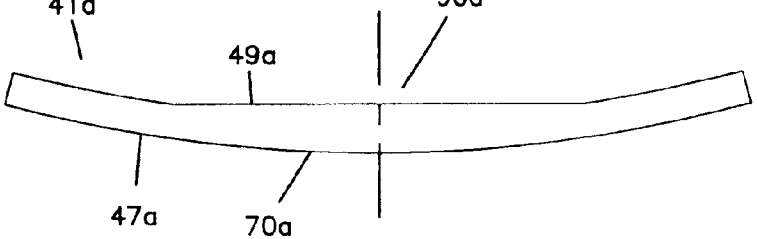
FIG. 4*a* represents a schematic view of one embodiment of a radial curvature in a sharpened edge in accordance with the principles of the present invention.
Figure 4B:
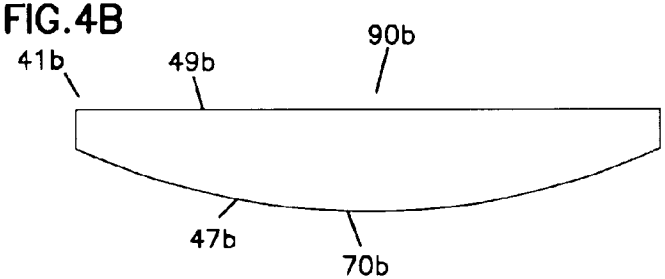
FIG. 4*b* represents a schematic view of one embodiment of a radial curvature in a sharpened edge in accordance with the principles of the present invention.

In another preferred embodiment, a sharpened edge 41 may be shaped as a radial curvature 70. FIGS. 4*a* and 4*b* illustrate examples of the front end view of a sharpened edge 41*a*, 41*b* with a radial curvature 70*a*, 70*b*, respectively. In FIG. 4*a*, the radial curvature 70*a* is provided to allow scraping of a sidewall of a container, such as exemplary container 100, so as to clean the container 100 of its contents. The radial curvature 70*a* of the sharpened edge 41*a* substantially corresponds with the sidewall of the container 100 such that the sharpened edge 41*a* is contactable with the sidewall of the container 100. Preferably, the radial curvature 70*a* corresponds to a 6.0 inch radius that is the curvature of a 6.0 inch radiused container. In FIG. 4*b*, the radial curvature 70*b* is illustrated as being at least on one side 47*b* of the sharpened edge 41*b*. The other side 49*b* is shown as a substantially flat surface. As depicted in FIG. 4*b*, the radial curvature 70*b* would have a cross-sectional size increasing towards a middle portion 90*b* of the sharpened edge 41*b*. Such a structure can provide an apparatus with additional strength and durability at the second end. It will be appreciated that the side 49*b* also may be other surfaces such as bulged, bumped or uneven surfaces, as long as it does not interfere with the structure of the sharpened edge 41*b* at side 47*b* from contacting a container sidewall.

Figure 5:
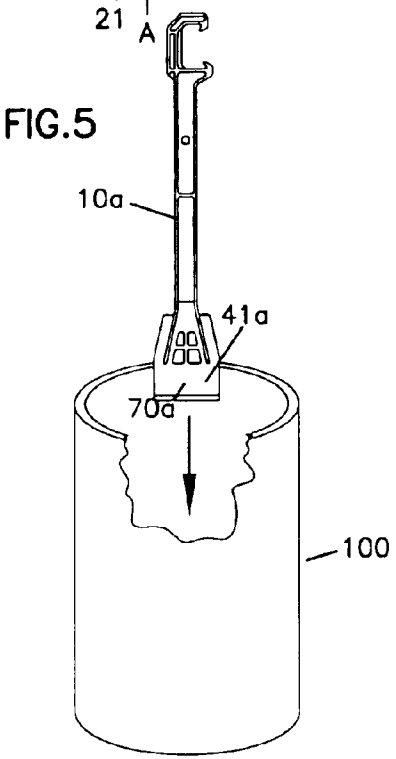
FIG. 5 represents a schematic view of one embodiment of an apparatus scraping the sides of a container.

FIG. 5 illustrates the apparatus 10*a* in contact with the sidewall of the container 100 and the arrow indicates a preferred scraping motion for scraping the sidewall. As the sharpened edge 41*a* having the radial curvature 70*a* contours the sidewall of the container, the apparatus 10*a* easily reaches and contacts the sidewall of the container 100. As the sharpened edge 41*a*, with the radial curvature 70*a*, contours the sidewall of the container, the need to manipulate the position of the container, such as by tilting or turning, can be significantly reduced making scraping less cumbersome and difficult. Furthermore, the radial curvature 70*a* of the sharpened edge 41*a* eliminates excessive scraping motions, otherwise required by flat bladed scraping tools, making it easier and more efficient in scraping the container 100. It will be appreciated that the sharpened edge 41*b* may also be used in the same manner as sharpened edge 41*a*.

It will be appreciated that the apparatus may be integrally formed of one tool. Also, the apparatus may be integrally molded of a plastic material, such as by injection molding. Preferably, the apparatus is a chemically resistant plastic material, such as polypropylene. It will be appreciated that other suitable plastic materials may be employed for the apparatus. Furthermore, the apparatus can be used on containers holding materials such as but not limited to plasterboard and drywall products, and also paint, and driveway sealer products. Preferably the containers are conventional five gallon containers or buckets that typically hold these products. Preferably, the five gallon buckets define a curvature where the bucket radius is about 6 inches.

Figure 6:
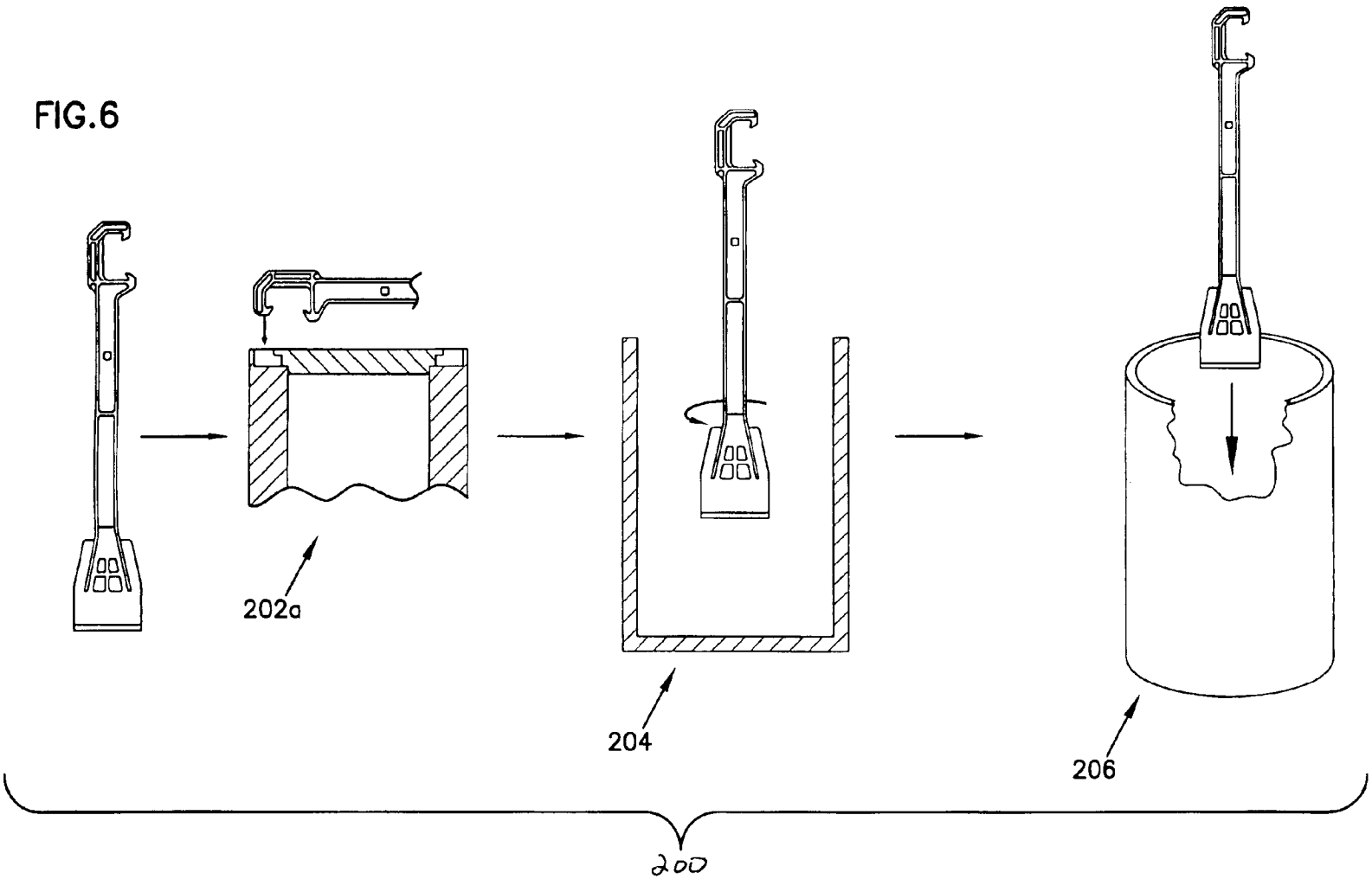
FIG. 6 represents a flow diagram of one embodiment of a method for removing contents from a container in accordance with the principles of the present invention.
Figure 7:
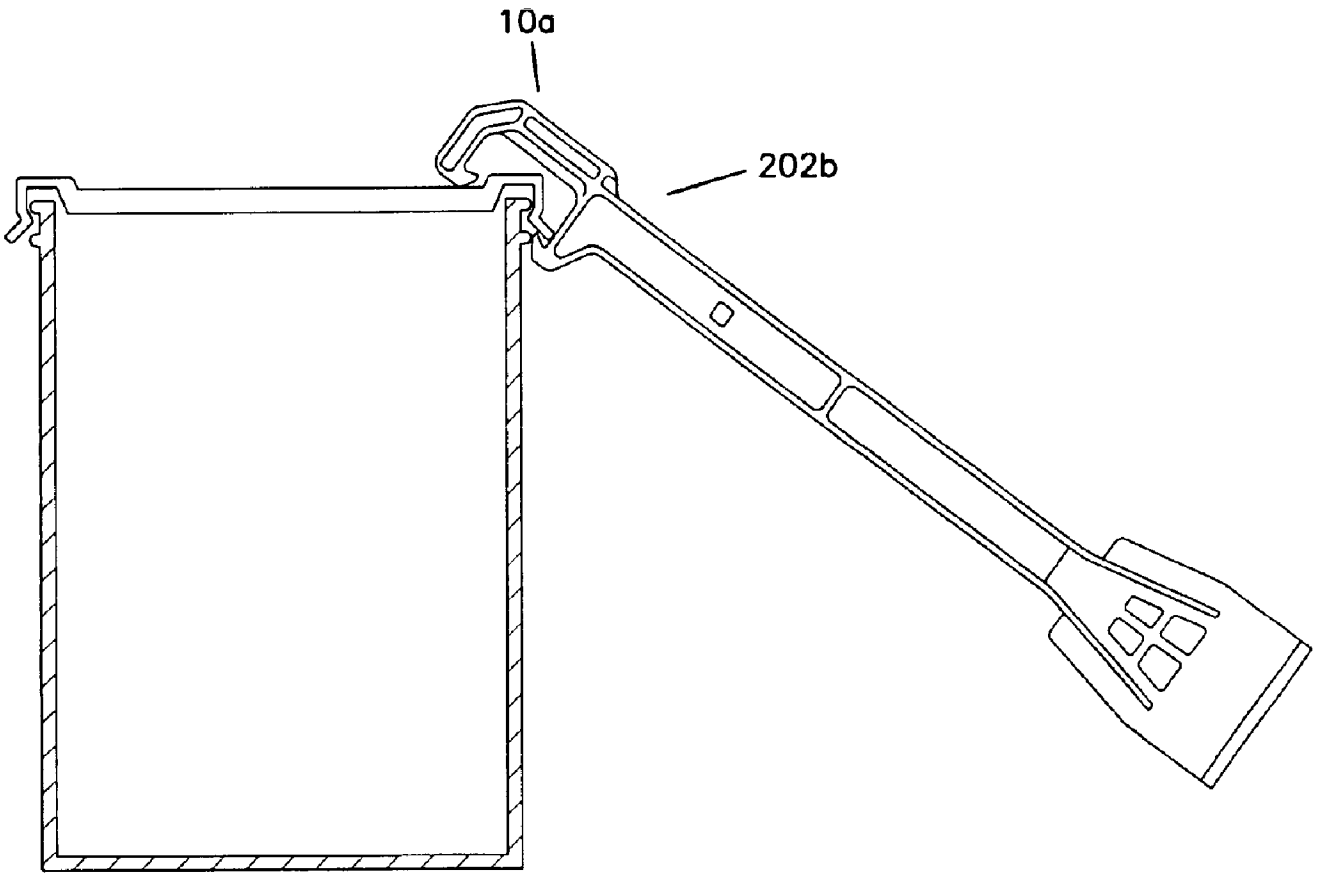
FIG. 7 represents a schematic view of a step for opening a container in accordance with the principles of the present invention.

FIG. 6 outlines another preferred embodiment of a method for removing contents from a container that includes providing an apparatus as previously described 200. Preferably, the apparatus is used on a bucket or container containing dry wall materials. The container is opened using the opener head 202*a*. The contents of the container are mixed 204 by stirring the contents using the apparatus where the cut outs allow flow through the tool support member during mixing. The container may be emptied and the sharpened edge including its radial curvature allows for downward scraping 206 of the container so as to clean out the container of its contents. FIG. 7 illustrates using the opener head of an apparatus 10*a* for opening a container 202*b* having an alternative cover. It will be appreciated that the apparatus 10*a* has features similar to apparatus 10.

As described above, the present invention provides the advantage of an apparatus being able to open a container, mix the contents contained within the container, and scrape the container clean of its contents. The invention provides the above features in one tool that is both convenient to use and cost effective. Further, the radial curvature in the sharpened edge allows for the apparatus to thoroughly and efficiently clean out the container of its contents by contouring the sidewall of the container allowing the apparatus to scrape along the sidewall.

The above specification, examples and data provide a complete description of the manufacture and use of the composition of the invention. Since many embodiments of the invention can be made without departing from the spirit and scope of the invention, the invention resides in the claims hereinafter appended.

We claim:

1. An apparatus that opens a container containing drywall material, mixes the drywall material contained in the container, and cleans out the drywall material in the container, the apparatus comprising:

an elongated member having a first end and a second end, the first end having an opener head operable for opening a container, and the second end including a tool support member, the tool support member having a width greater than a width of the elongated member, the tool support member having first and second ends, the tool support member including a plurality of cut out openings operable for mixing a material in a container and allowing the material to flow through the tool support member, the openings being defined through first and second sides of the tool support member, the second end including a sharpened edge operable for scraping and cleaning out a material in a container, the sharpened edge being disposed at the second end of the tool support member and along the width of the tool support member.

2. The apparatus according to claim 1, wherein the sharpened edge at the second end of the tool support member comprises a radial curvature capable of contouring the curvature in a sidewall of the container.

3. The apparatus according to claim 2, wherein the sharpened edge defines a cross-sectional area that increases toward a middle portion of the sharpened edge.

4. The apparatus according to claim 2, wherein the radial curvature corresponds to a 6.0 inch radius.

5. The apparatus according to claim 2, wherein the tool support member is curved and substantially corresponds with the radial curvature of the sharpened edge.

6. The apparatus according to claim 1, wherein the tool support member commonly supports the cut out openings and the sharpened edge.

7. The apparatus according to claim 1, wherein the elongated member is constructed of a plastic material.

8. The apparatus according to claim 1, wherein the elongated member is constructed of a chemically resistant plastic material.

9. The apparatus according to claim 1, wherein the elongated member is integrally formed of a moldable material as a one-piece structure requiring no assembly.

10. The apparatus according to claim 1, wherein the elongated member is disposable after use.

11. The apparatus according to claim 1, wherein the opener head including first and second portions spaced apart and extending from a side of the elongated member and including hook members at ends thereof; the first and second portions extending along the same axis that is transverse to the longitudinal axis of the elongated member.

12. The apparatus according to claim 11, wherein the opener head forms a C shaped opener head.

13. The apparatus according to claim 1, wherein the tool support member is substantially flat.

14. The apparatus according to claim 1, wherein the elongated member having a length greater than a length of the opener head.

15. The apparatus according to claim 1, wherein the elongated member having a length greater than a length of the tool support member.

16. The apparatus according to claim 1, wherein the cut out opening is a hole through the first and second sides of the tool support member.

17. A method of opening, mixing and cleaning a container using a single tool, comprising:

providing a tool that includes an elongated member having a first end and a second end, the first end having an opener head operable for opening the container, and the second end including a tool support member, the tool support member having a width greater than a width of the elongated member, the tool support member having first and second ends, the tool support member including a plurality of cut out openings operable for mixing a material in the container and allowing the material to flow through the tool support member, the openings being defined through first and second sides of the tool support member, the second end including a sharpened edge, operable for scraping and cleaning out a material in the container, the sharpened edge being disposed at the second end of the tool support member and along the width of the tool support member;

opening the container using the opener head;

mixing contents in the container by inserting the second end of the tool into the container and stirring so as to allow the contents to flow through the cut out opening and mix the contents; and cleaning out the container by contacting the sharpened edge against the sidewall of the container so as to contour the container using the sharpened edge and scraping against the sidewall to remove contents against the sidewall to be emptied.

* * * * *